United States Patent [19]

Furness et al.

[11] 4,287,744

[45] Sep. 8, 1981

[54] TAPER ROLLING MACHINE

[75] Inventors: Edward J. Furness, Sheffield; Philip Wade, Barnsley, both of England

[73] Assignee: British Steel Corporation, London, England

[21] Appl. No.: 74,169

[22] Filed: Sep. 10, 1979

[30] Foreign Application Priority Data

Sep. 19, 1978 [GB] United Kingdom ..... 37325/78

[51] Int. Cl.[3] ..... B21B 1/42

[52] U.S. Cl. ..... 72/214; 72/240; 72/252

[58] Field of Search ..... 72/240, 252, 214, 207, 72/250, 199; 414/14–17

[56] References Cited

U.S. PATENT DOCUMENTS

| | | | |
|---|---|---|---|
| 1,147,985 | 7/1915 | Sturgis | 72/232 |
| 1,652,860 | 12/1927 | Heinle | 72/240 |
| 2,092,188 | 9/1937 | Simons | 72/366 |
| 2,995,050 | 8/1961 | Karron et al. | 72/240 |
| 3,233,444 | 2/1966 | Groves et al. | 72/207 |

FOREIGN PATENT DOCUMENTS

| | | | |
|---|---|---|---|
| 704659 | 3/1941 | Fed. Rep. of Germany | 72/207 |
| 974990 | 11/1964 | United Kingdom | 72/207 |
| 1017706 | 1/1966 | United Kingdom | 72/252 |
| 1089332 | 11/1967 | United Kingdom | 72/250 |
| 1128102 | 9/1968 | United Kingdom | 72/8 |
| 1329312 | 9/1973 | United Kingdom | 72/8 |
| 1380691 | 1/1975 | United Kingdom | 72/240 |

*Primary Examiner*—Milton S. Mehr

*Attorney, Agent, or Firm*—Bacon & Thomas

[57] ABSTRACT

The invention relates to a taper rolling machine which is designed such that the stock may follow a constant pass line throughout the whole of the taper rolling operation.

In particular the taper rolling apparatus comprises a pair of idler rolls (7 and 8) and a carriage (2) for gripping the stock (12) and drawing it through the rolls in a multiplicity of passes whilst the roll gap is controlled to impart the taper, this roll gap being adjusted by movement of only one (8) of the idler rolls. The invention is manifested by the carriage (2) being pivotally mounted at 6 and resiliently supported at its forward end by pneumatic, hydraulic or mechanical spring means—this enables the carriage to move in such a fashion as to maintain the stock at a level by which a constant pass line is secured.

10 Claims, 3 Drawing Figures

TAPER ROLLING MACHINE

This invention relates to the taper rolling of metals and more particularly relates to apparatus for rolling tapered springs from steel plate.

From one aspect, the present invention provides apparatus for taper rolling a length of stock comprising a pair of idler rolls, a carriage for gripping the stock and drawing it through the rolls in a multiplicity of passes whilst the roll gap is controlled to impart the taper, the roll gap being adjusted by movement of only one of the idler rolls in a direction perpendicular to the movement of the stock, and the carriage being resiliently mounted for movement in the said direction whereby to maintain a substantially constant pass line through the stock throughout the taper rolling thereof.

The carriage may be pivotally mounted at its end remote from the roll head and resiliently mounted adjacent its other end by pneumatic, hydraulic or mechanical (spring) means. Preferably, the roll gap is controlled by formers which are tapered to conform with that desired on the stock, the formers being drawn through the rolls together with the stock. With the rolls seating on the formers the appropriate contour is imparted to the stock, the full taper being built up after a number of passes of the carriage.

As mentioned, this invention provides for the stock to follow a constant pass line throughout the whole of the taper rolling operation.

Hitherto this has been made possible by a different design of machine employing two idler rollers both movable in a "scissors-like" formation. The design of such a machine however is fairly complex as distinct from the current arrangements where only one roll is movable.

Apparatus embodying a fixed lower roll has indeed been provided before—e.g. as shown in U.S. Pat. No. 3,417,592—but stock rolled in such a machine does not follow a constant pass line. In particular, machines of this previous type suffer a great deal of wear along the carriage seating by reason of the bending moment which is applied to the stock during drawing. This can be most readily explained by assuming that the lower face of the stock is initially aligned with the surface of the fixed lower roll as it is introduced between the rollers. Subsequently as the upper roll is impressed into the stock during the drawing step the stock is worked into its tapered form equally from both sides so that the centre line of the stock moves downwardly towards the bottom roll. The centre line is progressively depressed as each pass is conducted. The stock is thus effectively "bent" from its clamping position and this imposes severe strains on the carriage seating.

The current invention mitigates this problem, the stock being effectively self-levelling.

In order that the invention may be fully understood, one embodiment thereof will be described, by way of example, with reference to the accompanying drawing in which.

Figure 1:
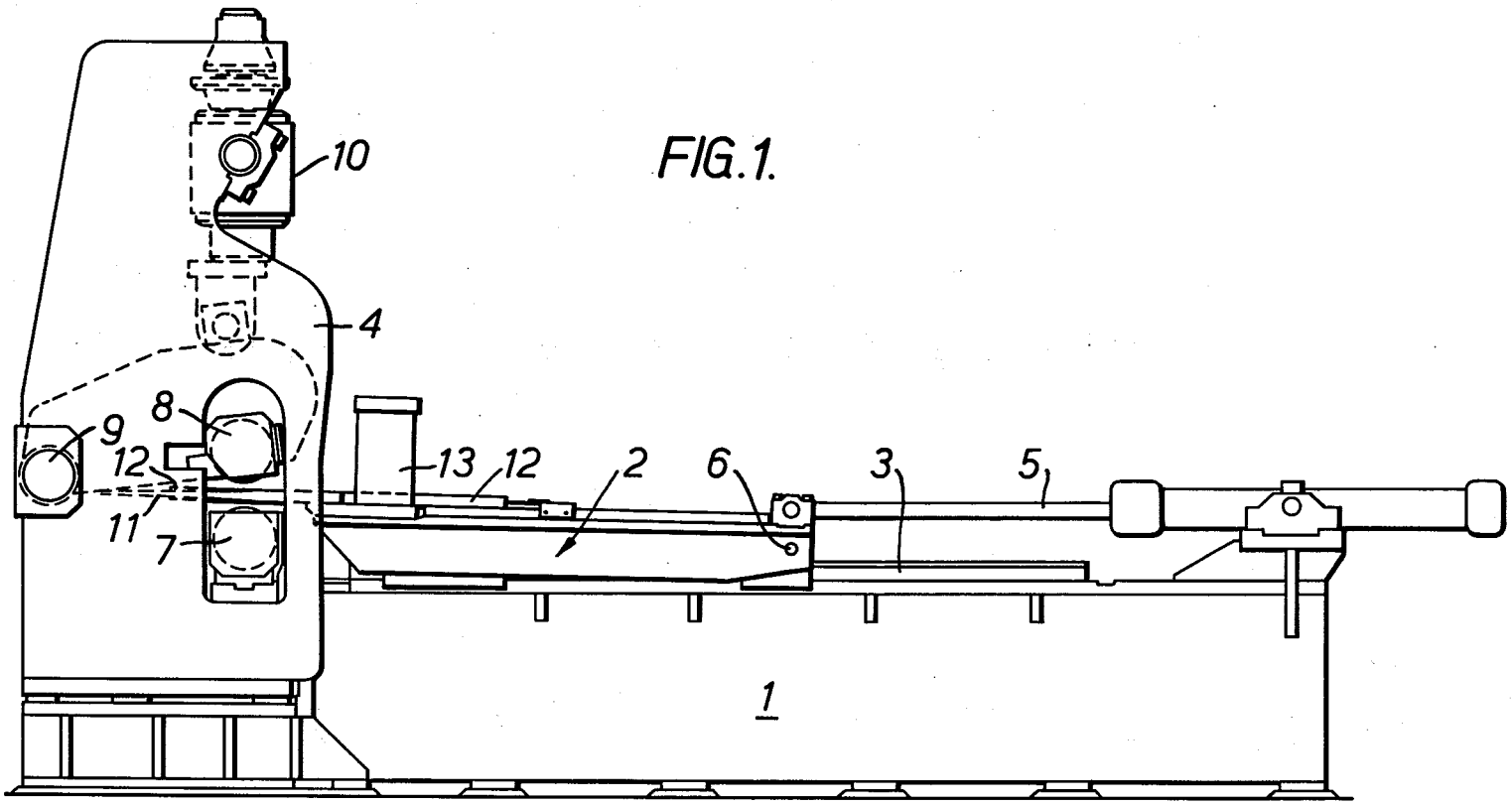
FIG. 1 is a side elevation of a taper rolling machine according to this invention, shown with the carriage in the advanced position prior to drawing.
Figure 2:
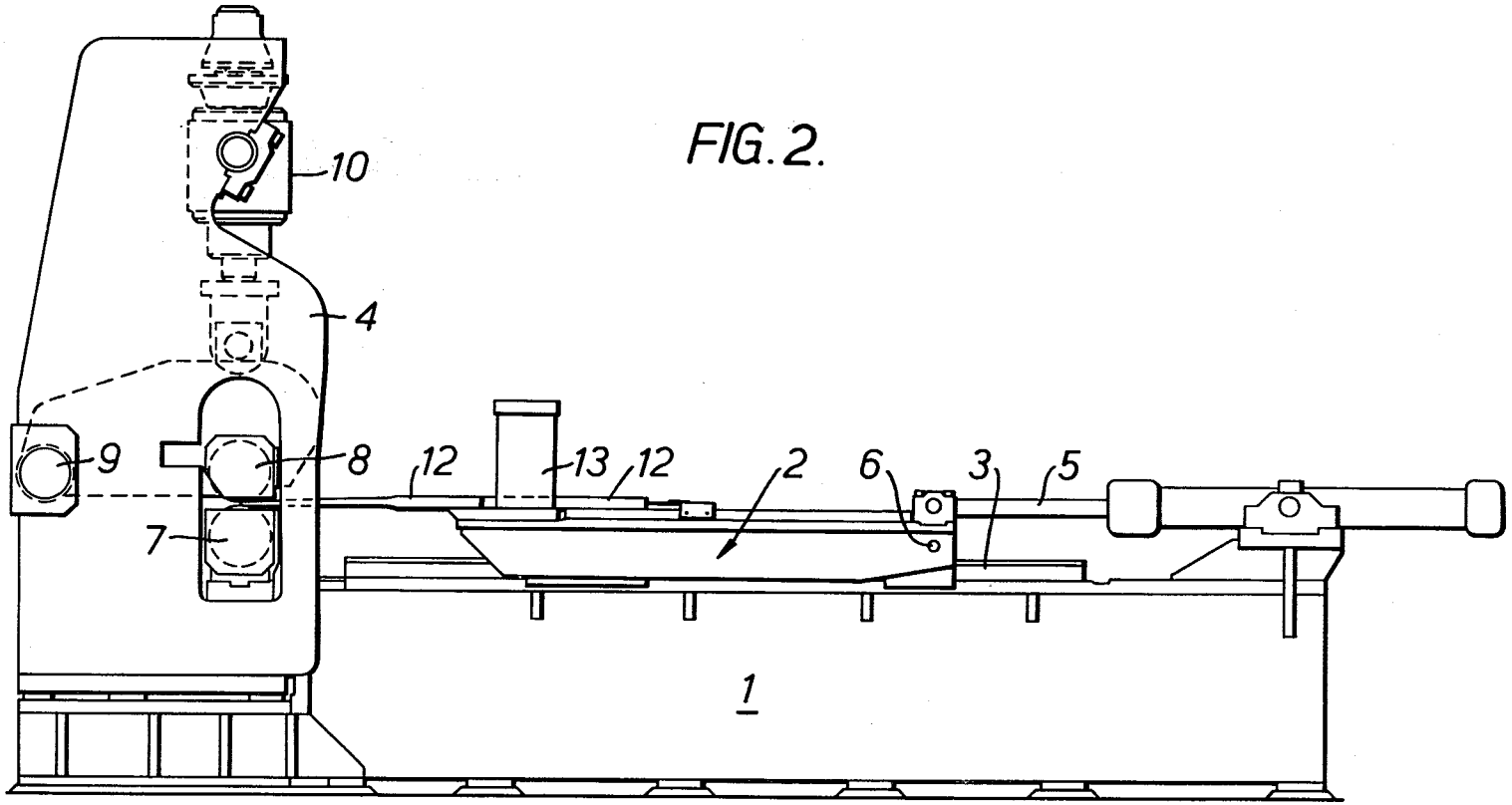
FIG. 2 is a similar side elevation to that shown in FIG. 1 but with the carriage retracted on the completion of drawing; and, FIG. 3 is a sectional side elevation through part of the carriage showing the pneumatic mechanism for resiliently mounting this part.

Referring now to FIGS. 1 and 2 in the drawings, the apparatus comprises a frame 1 on which is mounted a carriage 2 reciprocally movable on a bed 3 towards and away from the roll head 4 by an hydraulic ram mechanism 5. The carriage is pivotally mounted at its rear end about the pivot pin 6 and is resiliently supported at its forward end in a manner more fully described with reference to FIG. 3. The head includes two rolls which are supported for idle rotation, the lower one 7 about a fixed axis and the upper one 8 about an axis which itself pivots about the bearing shaft 9. This pivotal movement is effected by an hydraulic control mechanism 10 which thus varies the gap between the two rolls.

As will be apparent from the description of the operation to follow, the gap is in fact governed in this design by two tapered formers—one of which (11) is partially visible in FIG. 1—which are secured to the carriage and lie on opposite sides to the stock (plate) 12 which is clamped in position on the carriage by an hydraulic clamp 13. This feature is the same as that described and illustrated in U.S. Pat. No. 3,417,592.

Figure 3:
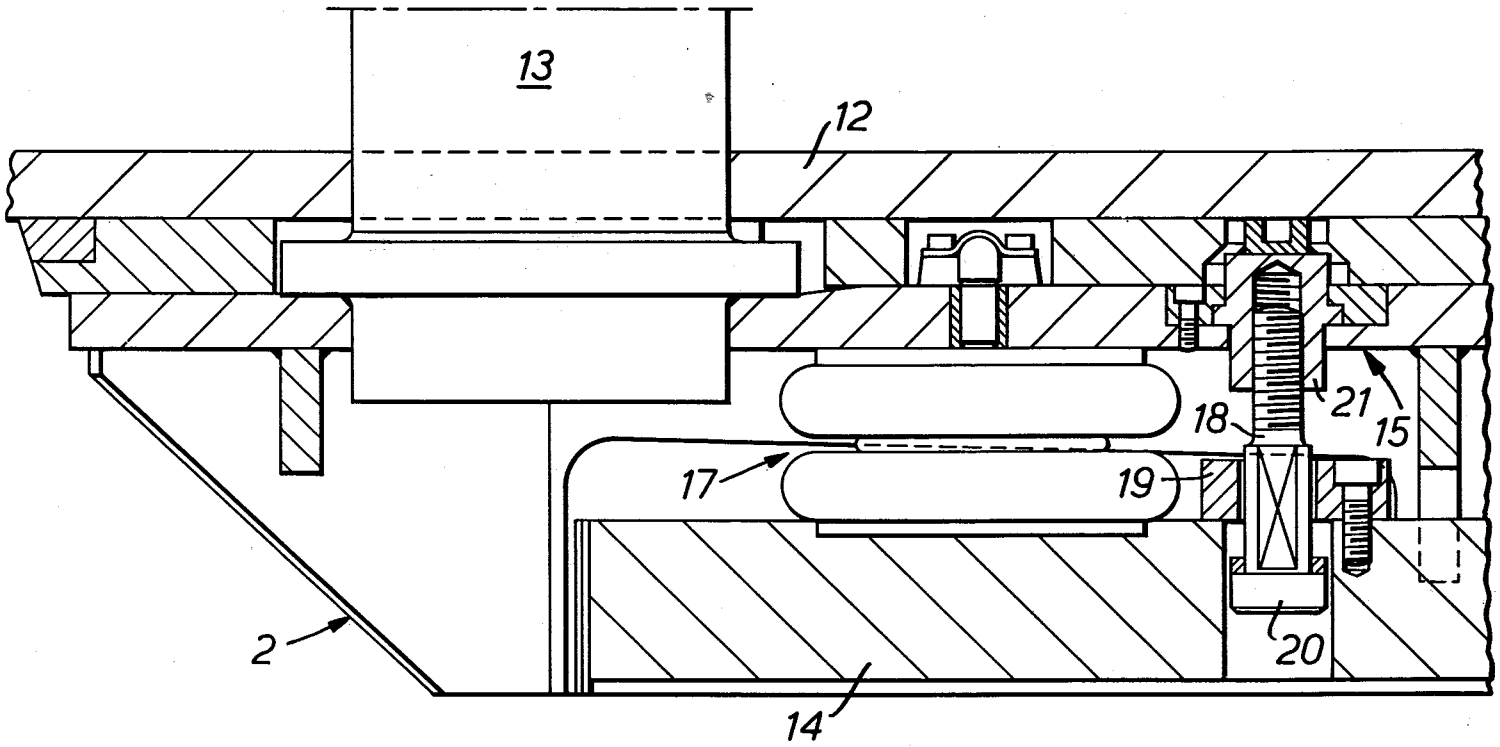

Referring now to FIG. 3 there is shown a section through the forward end of the carriage. The carriage basically comprises two parts, the base 14 which bears on the bed of the frame 1 and the support structure 15 which is pivotally mounted at 6, as mentioned above. This support structure supports the stock 12 which is clamped in position by the clamp 13.

Mounted between the two parts 14,15 are butyl rubber pneumatic bellows 17—e.g. of the types known as Pneuride (Martonair) or Airstroke (Firestone). The air connection to these bellows is not shown but as they are inflated so the structure 15 rises and as they are deflated so it falls. A limit to the degree of excursion in this regard is provided by an adjustable screw-threaded member 18 which freely moves through a 'stop' plate 19 against which abuts the head 20 of the member at one limit and a threaded boss 21 on the structure 15 at the other limit.

In operation, the hot steel plate 12 is clamped in position with the carriage fully retracted, the rolls 7,8 are in the open position, the bellows 17 are inflated to lift the carriage so that the plate just clears the lower roll 7 and the carriage is advanced to the position shown in FIG. 1 by operation of the ram mechanism 5. With the carriage in this position a limit switch (not shown) is tripped whereupon the hydraulic mechanism 10 is actuated and the upper roll 8 is moved downwardly to seat on the plate and the formers 11. The carriage is withdrawn and the rolls follow the contour of the formers rolling out the plate to the desired tapered form as shown in FIG. 2. The pass line is maintained substantially constant throughout, since the bellows are compressed to permit the depression of the plate as it is worked from both sides thus relieving the strain on the plate which would otherwise be manifested and which, as previously mentioned, would be transmitted to the carriage seating.

At the completion of each pass the carriage assumes its initial disposition with the load on the bellows being relieved and the carriage trips another limit switch which causes the rolls 7,8 to assume the open position.

In practice the whole of the tapered form is not produced with just a single pass. The stock is tapered in a number of passes of the carriage e.g. three. The rolls are initially closed on the thick end of the formers and follow them down over, say, one third of the plate length as the carriage is withdrawn, whereupon the rolls are then held in a fixed relationship to roll out the remainder of the plate in a parallel fashion for the remainder of that pass. The succeeding two passes taper roll the plate over each of the remaining two thirds of its length in a similar fashion although a thickened portion may be produced at the extreme end of the plate. This practice is well known however and is described here only to aid the understanding of the operation of this machine.

The invention thus provides a taper rolling machine having only one movable roll and which yet draws stock in a tapered fashion along a substantially constant pass line.

Although this invention has been described with reference to the particular embodiment illustrated, it is to be understood that various modifications may readily be made without departing from the scope of the invention.

For example, the upper roll may move along a vertical plane instead of along an accurate path as shown; furthermore the upper roll may be fixed and the lower roll be movable instead if desired. The air pressure within the bellows may be controlled if desired so that, when the plate is positioned between the rolls, the bellows are deflated sufficiently to allow the material to bear on the fixed roll, the bellows subsequently being inflated when the carriage is withdrawn to raise the plate ready for the next stroke. The pivotally mounted carriage is a particularly simple form of construction for enabling the carriage to be resiliently mounted for movement in the direction of movement of the movable idler roll, but a more accurate form of control could alternatively be provided by arranging for the carriage to move bodily in this (vertical) direction.

The pneumatic means shown is only one form of resilient mounting, clearly springs or other forms of mechanical control may be utilised as also may hydraulic means.

Tapered forms other than the uniform one shown may alternatively be imparted to the plate, e.g. parabolic, and discontinuities may readily be introduced if desired. Further, the formers for determining the taper may not necessarily be used and remote control means may instead be utilised for governing the progressive reduction of the roll gap during drawing.

We claim:

1. Apparatus for taper rolling a length of stock comprising a roll head having a pair of idler rolls defining a roll gap therebetween; a carriage for gripping the stock and drawing it through the rolls in a multiplicity of passes whilst the roll gap is controlled to impart the taper; adjustment means to adjust the roll gap by effecting movement of only one of the idler rolls in a direction perpendicular to the movement of the stock; and, resilient mounting means attached to said carriage for resiliently mounting it for movement in a direction perpendicular to the movement of the stock so as to maintain a substantially constant pass line through the stock throughout the taper rolling thereof.

2. Apparatus according to claim 1, in which the carriage is pivotally mounted at its end remote from the roll head, and wherein said resilient mounting means is located adjacent its other end and comprises fluid means.

3. Apparatus according to claim 2, in which the resilient mounting means comprises fluid means, the pressure in which is controllable to govern the vertical portion of the stock between the passes conducted during the taper rolling.

4. Apparatus according to claim 3, in which the fluid means comprises a pneumatically operated bellows unit mounted in the carriage.

5. Apparatus according to claim 4 in which the roll gap is governed by formers which are tapered to conform with that desired on the stock, the formers being drawn through the rolls together with the stock.

6. Apparatus for taper rolling a length of stock comprising a roll head having a pair of idler rolls defining a roll gap therebetween; a carriage for gripping the stock and drawing it through the rolls in a multiplicity of passes whilst the roll gap is controlled to impart the taper; control means imposed on only one of said idler rolls; means pivotally mounting said one of said idler rolls to move in an arcuate path perpendicular to the movement of the stock to adjust the said roll gap; and, resilient mounting means attached to said carriage for resiliently mounting it for movement in a direction perpendicular to the movement of the stock so as to maintain a substantially constant pass line through the stock throughout the taper rolling thereof.

7. Apparatus according to claim 6, in which the said one of said idler rolls is mounted above the stock.

8. Apparatus according to claim 7, in which the roll gap is governed by formers which are tapered to conform with that desired on the stock, the formers being drawn through the rolls together with the stock.

9. Apparatus according to claim 7, in which the roll gap is controlled in accordance with means remote from the carriage which manifest the taper desired on the stock.

10. A method of taper rolling a length of stock in an apparatus having a resiliently mounted carriage to which the stock is attached, a roll head having a pair of idler rolls defining a roll gap therebetween, and means to reciprocate the carriage such that the length of stock passes forward and backward between the pair of idler rolls, comprising the steps of:

(a) raising the resilient mount on said carriage during a forward pass to raise the stock such that it freely extends between the rolls;

(b) moving one of said idler rolls in a direction perpendicular to the movement of the stock to close the roll gap when the carriage reaches the limit of its forward travel; and, (c) moving the stock and carriage in a backward direction such that the idler rolls work the stock into a tapered form wherein the resilient mounting accommodates the force imposed on the stock to maintain a constant pass line.

* * * * *